US007362298B2

(12) United States Patent
Wakabayashi

(10) Patent No.: US 7,362,298 B2
(45) Date of Patent: Apr. 22, 2008

(54) PIXEL CIRCUIT, LIGHT-EMITTING DEVICE AND ELECTRONIC DEVICE

(75) Inventor: Junichi Wakabayashi, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/336,894

(22) Filed: Jan. 23, 2006

(65) Prior Publication Data

US 2006/0164360 A1 Jul. 27, 2006

(30) Foreign Application Priority Data

Jan. 27, 2005 (JP) ..... 2005-019264
Dec. 1, 2005 (JP) ..... 2005-347545

(51) Int. Cl.
*G09G 3/36* (2006.01)

(52) U.S. Cl. ..... 345/94; 345/92; 345/82; 345/76; 345/214

(58) Field of Classification Search ..... 315/169.3, 315/169.4; 345/94, 76, 82, 205, 90, 92
See application file for complete search history.

(56) References Cited

U.S. PATENT DOCUMENTS 5,714,968 A * 2/1998 Ikeda ..... 345/77
6,011,529 A * 1/2000 Ikeda ..... 345/77
6,556,265 B1 * 4/2003 Murade ..... 349/111
6,583,581 B2 * 6/2003 Kaneko et al. ..... 315/169.3
6,882,113 B2 * 4/2005 Kaneko et al. ..... 315/169.3
7,053,875 B2 * 5/2006 Chou ..... 345/92
7,180,515 B2 * 2/2007 Miyagawa et al. ..... 345/212
2004/0135521 A1 * 7/2004 Park ..... 315/169.3
2005/0205880 A1 * 9/2005 Anzai et al. ..... 257/83

FOREIGN PATENT DOCUMENTS

JP 5-241536 9/1993
JP 9-212133 8/1997

* cited by examiner

*Primary Examiner*—Douglas W. Owens
(74) *Attorney, Agent, or Firm*—Oliff & Berridge, PLC

(57) ABSTRACT

A pixel circuit includes a light-emitting element that has a luminance corresponding to a level of a driving signal; and a signal generating circuit that generates a driving signal indicating the luminance of the light-emitting element on the basis of a data signal. The signal generating circuit includes a driving transistor that generates a driving signal by supplying a voltage corresponding to a data signal to its gate electrode, and a time constant circuit that rounds a waveform of the driving signal supplied from the driving transistor to the light-emitting element.

12 Claims, 10 Drawing Sheets

PIXEL CIRCUIT, LIGHT-EMITTING DEVICE AND ELECTRONIC DEVICE

The entire disclosure of Japanese patent application Nos: 2005-019264, filed Jan. 27, 2005 and 2005-347545, filed Dec. 1, 2005 are expressly incorporated by reference herein.

BACKGROUND

1. Technical Field

The present invention relates to a technology that controls light-emitting elements such as organic light emitting diode (OLED) elements.

2. Related Art

A light-emitting device having a plurality of light-emitting elements has been proposed. In the light-emitting device, a deviation in luminance of the light-emitting element occurs due to various reasons such as the delay of a signal representing luminance of a light-emitting element (hereinafter referred to as a ("data signal").

For example, a light-emitting device having a construction in which a plurality of pixel circuits, each having a light-emitting element, is connected to a common line (hereinafter referred to as a "data signal line") has been proposed. In this construction, the data signal which specifies luminance of each light-emitting element in a time sharing manner is sequentially input from the data signal line to each pixel circuit for a predetermined period (hereinafter referred to as a "sampling period") and a driving signal generated on the basis of the data signal luminance of a light-emitting element is supplied to control the luminance of the light-emitting element. In this construction, if a period when the data signal is maintained at a level corresponding to the luminance of one light-emitting element and a sampling period for the data signal completely coincide with each other on a time axis, the luminance of the light-emitting element can be properly controlled by supplying a predetermined period of the data signal to each pixel circuit. However, there is a case where a data signal is delayed for the sampling period due to various reasons, such as an unsharpened waveform when the signal is propagated along the data signal line. In this case, since a level of the data signal is varied within one sampling period, a predetermined driving signal cannot be supplied to a light-emitting element. As a result, a deviation in luminance of the light-emitting element may occur.

As technologies for solving the above problem, JP-A-5-241536 (FIGS. 1 and 2) or JP-A-9-212133 (FIGS. 1 and 2) discloses a construction in which an interval Pd is inserted between sampling periods Ps, as shown in FIG. 16. Corresponding to the above construction, during the interval Pd from the end point of each sampling period Ps to the start point of the sampling period Ps immediately after thereof, a data signal D is not supplied to any pixel circuit. Therefore, even though the data signal D is delayed by a time length Δd as indicated by "D (delayed)" in FIG. 16, deviation is not generated in luminance of a light-emitting element if the delay amount Δd falls within a range of a time length of the interval Pd.

In the related art, however, a time length (the sampling period Ps) in which the data signal D is supplied to each pixel circuit must be shortened as long as the interval Pd. Therefore, when a data signal must be sampled within a short period in each pixel circuit (e.g., when the number of pixel circuits connected to the data signal line is many), a problem arises because the data signal cannot be sufficiently supplied to each pixel circuit and it becomes difficult to control the luminance of each light-emitting element.

SUMMARY

An advantage of some aspects of the invention is that it prevents deviation in luminance of each light-emitting element without shortening a time length when a signal specifying luminance of the light-emitting element is supplied to a pixel circuit.

A pixel circuit according to an aspect of the invention includes a light-emitting element that has a luminance corresponding to a level of a driving signal and a signal generating circuit that generates a driving signal indicating the luminance of the light-emitting element on the basis of a data signal. The signal generating circuit includes a driving transistor (e.g., a driving transistor 81 in FIG. 3 or an inverter Cb1 in FIG. 9) that generates a driving signal by supplying a voltage corresponding to a data signal to its gate electrode, and a time constant circuit (i.e., decreases an amount of shift per unit time in a level of a driving signal) that rounds a waveform of the driving signal supplied from the driving transistor to the light-emitting element.

In this construction, a waveform of a driving signal supplied from the signal generating circuit to the light-emitting element is rounded by the time constant circuit. Therefore, even if a driving signal shifts to a level different from a predetermined value for a short period of time due to various causes such as delay or noise, the influence on luminance of the light-emitting element can be decreased. Furthermore, since the influence due to the shift in the driving signal is relieved by the time constant circuit, it is not necessary to shorten a time length where a signal (a data signal) to specify luminance of a light-emitting element, which is supplied to the pixel circuit. Furthermore, the light-emitting element according to an aspect of the invention is a device that emits light through an electrical operation. For example, various devices, such as inorganic EL diode elements and light-emitting diode elements, as well as OLED elements can be included in the concept of the light-emitting element in the invention.

In the pixel circuit having the light-emitting element that emits light when a level of a driving signal exceeds a predetermined threshold value, when, among data signals input to the signal generating circuit, a signal exceeding the threshold value is input to the signal generating circuit with a time length shorter than a predetermined time length, the time constant circuit sets a time constant so that a signal output from the time constant circuit decreases to a level lower than the threshold value of the light-emitting element. According to this aspect, although a level of the driving signal exceeds a threshold value of a light-emitting element for a short period of time, the level of the period decreases to a level lower than the threshold value by the time constant circuit. Therefore, luminance error of the light-emitting element caused by a shift in the driving signal can be reliably prevented. In an aspect of the invention, however, the entire periods whose level exceeds a threshold value as long as a time length shorter than a predetermined value, of the driving signal, need not to necessarily decrease to a level lower than the threshold value. That is, a wavelength of the driving signal can be rounded so that the wavelength of the driving signal has a time length of the degree in which a period whose level exceeds a threshold value (i.e., a period where the light-emitting element erroneously emits light) is not problematic in using a pixel circuit although the level of the driving signal whose waveform is rounded by the time constant circuit exceeds the threshold value. For example, in a display apparatus employing the pixel circuit of the invention, although the light-emitting element erroneously emits light due to delay of a driving signal, if it is a time length of the degree in which it cannot be perceived by a human's eye, desired effects of the invention can be certainly obtained.

In a preferred aspect of the invention, the light-emitting element includes first and second electrodes, and a power supply line electrically connected to the first electrode through the driving transistor. The time constant circuit is disposed between the power supply line and the first electrode. According to this aspect, erroneous emitting of a light-emitting element can be effectively prevented.

Furthermore, according to another aspect of the invention, a sampling circuit (e.g., a transmission gate 71 in FIG. 3) that samples the data signal indicating a luminance of a light-emitting element from the data signal line for the sampling period is provided. The signal generating circuit generates a driving signal according to the data signal sampled by the sampling circuit. In this construction, a time constant of the time constant circuit is set so that a period whose level exceeds a threshold value of a light-emitting element by a time length shorter than a delay amount of the data signal for the sampling period, of the driving signal generated by the signal generating circuit, decreases to a level lower than the threshold value. However, a construction in which the signal generating circuit samples the data signal is also possible. That is, the signal generating circuit constructed above includes a switching element connected to, e.g., a data signal line, and samples the data signal supplied to the data signal line and outputs the sampled signal as a driving signal.

According to a preferred aspect of the invention, the time constant circuit includes a capacitive element e.g., a capacitor Ca shown in FIG. 3 or FIG. 11) having one electrode connected to the first electrode of the light-emitting element and the other electrode applied with a predetermined potential. According to the aspect, for example, resistance component or wiring resistance of a light-emitting element and the capacitor constitute a RC time constant circuit. According to the aspect, the construction of the time constant circuit can be simplified. Furthermore, the time constant circuit includes a resistor intervened between the power supply line and the first electrode. In this aspect, a capacitor (e.g., a capacitive element connected to the first electrode of the light-emitting element or a capacitor incidental to a light-emitting element) and the above resistor constitute a RC time constant circuit.

Furthermore, according to another aspect, the driving transistor is a first inverting circuit (e.g., an inverter Cb1 shown in FIG. 9 or 12) having first and second transistors, which are a complementary type. The time constant circuit is a second inverting circuit (e.g., an inverter Cb2 shown in FIG. 9 or 12) having third and fourth transistors, which are a complementary type. A potential corresponding to the data signal is supplied to an input terminal of the first inverting circuit, an output terminal of the first inverting circuit is connected to an input terminal of the second inverting circuit, and an output terminal of the second inverting circuit is connected to the first electrode. Furthermore, in the above aspect, the first and second transistors correspond to transistors, such as transistors Tr1, Tr2, respectively, in the inverter Cb1 of FIG. 9 or 12. In addition, the third and fourth transistors correspond to transistors, such as transistors Tr1, Tr2, respectively, in the inverter Cb2 of FIG. 9 or 12.

In this aspect, gate capacitance of transistors constituting the first inverting circuit or the second inverting circuit, or output impedance of the inverter constitutes a RC time constant circuit. Furthermore, a time constant circuit with a predetermined time constant can be constructed by properly selecting a stage number of an inverter or the size of transistors constituting the inverter (more particularly, a gate length and/or a gate width). However, the construction of the time constant circuit is not limited to the above example. For example, when the signal generating circuit is configured by a transistor, the time constant circuit can be constructed using gate capacitance of the transistor. In this construction, a time constant of the time constant circuit can be controlled by properly selecting a gate width or a gate length of the transistor.

Furthermore, the pixel circuit according to an aspect of the invention is used in a light-emitting device. The light-emitting device includes a plurality of pixel circuits, each including a light-emitting element that has a luminance corresponding to a level of a driving signal, and a data signal line that transmits a data signal indicating a luminance of each light-emitting element in a time sharing manner. Each of the plurality of pixel circuits includes a signal generator that generates a driving signal corresponding to a level of a data signal sampled from the data signal line for a sampling period corresponding to the pixel circuit. The signal generator includes a driving transistor that generates a driving signal by supplying a voltage corresponding to a data signal to its gate electrode, and a time constant circuit that rounds a waveform of the driving signal supplied from the driving transistor to the light-emitting element. Corresponding to the construction, luminance error of each light-emitting element can be prevented without shortening a period (a sampling period) where the data signal is supplied to the pixel circuit by the same operation as that of the pixel circuit according to an aspect of the invention.

In the light-emitting device according to a preferred aspect of the invention, the light-emitting element emits light when a level of a driving signal exceeds a threshold value. When, among data signals input to the signal generating circuit, a signal exceeding the threshold value is input to the signal generating circuit with a time length shorter than a predetermined time length, the time constant circuit sets a time constant so that a signal output from the time constant circuit decreases to a level lower than the threshold value of the light-emitting element. According to this construction, luminance error of a light-emitting element caused by the delay of a data signal for the sampling period, can be reliably prevented.

However, the data signal line is accompanied by wiring resistance and/or parasitic capacitance. Resistance or capacitance rises when becoming more distant from a supply source of a data signal (e.g., an image processing circuit 30 shown in FIG. 1, or a terminal to which the data signal output from the image processing circuit 30 is input) along the data signal line. Therefore, a time constant set according to resistance and/or capacitance becomes high when becoming more distinct from the supply source of the data signal. Therefore, if the same time constant as that of the time constant circuit is set for the entire pixel circuits, a driving signal decreases based on a time constant that becomes high as the pixel circuit becomes more distant from the supply source of the data signal. As a result, the operation of light-emitting elements may be unstable. For this reason, in a preferred aspect of the invention, a time constant of a time constant circuit included in each pixel circuit is set according to a point where the pixel circuit is connected, of the data signal line. For example, in the case of a first pixel circuit, and a second pixel circuit connected to a point where a path length from a supply source of a data signal is shorter than that of the first pixel circuit, of the data signal line, a time constant of a time constant circuit included in the first pixel circuit is smaller than that of a time constant circuit included in the second pixel circuit. According to this construction, resistance and/or capacitance incidental to the data signal line and a time constant taking both the time constant circuits into consideration can be equalized in each pixel circuit. It is thus possible to prevent unstable operation of the light-emitting elements.

In a more preferred aspect, a time constant of a time constant circuit included in each pixel circuit is set for every pixel circuit so that wiring resistance and/or parasitic capacitance from a supply source of a data signal to a point where the pixel circuit is connected, of the data signal line, and a time constant of a portion including the time constant circuit of the pixel circuit approximately become the same for the entire pixel circuits. According to this construction, the entire light-emitting elements can be stably operated with good accuracy without regard to the location of the pixel circuit from the data signal line. In this construction, however, there is a possibility that the construction may be complicated because a time constant must be separately selected every pixel circuit. For this reason, a construction in which a time constant is selected every group of pixel circuits can be also adopted. That is, in a light-emitting device according to another aspect of the invention, a time constant of the time constant circuit included in each pixel circuit is set for every group of the pixel circuit so that a time constant of a time constant circuit of each of pixel circuits belonging to a first group of the plurality of pixel circuits is smaller than that of a time constant circuit of each of pixel circuits belonging to a second group connected to a point where a path length from a supply source of a data signal, of the data signal line, is shorter than that of each pixel circuit of the first group. Furthermore, in this case, although only the first and second groups are illustrated, it is not intended that the invention is limited to the above construction in which the plurality of pixel circuits includes the two groups. In a construction in which a plurality of pixel circuits has three or more groups, one of the three groups can correspond to the first group in the invention, and the other one of the three groups can correspond to the second group in the invention.

The light-emitting device according to an aspect of the invention can be used in a variety of electronic devices. For example, in an image forming apparatus having a photosensitive material on which images are formed by irradiating light, the light-emitting device can be used as a head (a line head) that irradiates light to the photosensitive material. Examples of the image forming apparatus may include a printer, a copy machine, and a combined apparatus having both functions of the printer and copy machine. A light-emitting device in which a plurality of light-emitting elements is linearly arranged is appropriate for the image forming apparatus. The light-emitting device according to the invention can also be used as display devices of various electronic devices such as mobile telephones and personal computers. A light-emitting device in which a plurality of light-emitting elements is arranged in a matrix form is also appropriate for the electronic devices. That is, the light-emitting device includes a vertical scan circuit (e.g., a shift register shown in FIG. 8) and a horizontal scan circuit (e.g., the image processing circuit 30 shown in FIG. 8). In the vertical scan circuit, the pixel circuit of the invention is disposed corresponding to each of the intersections of a plurality of sampling signal lines (scan lines) and a plurality of data signal lines, and the plurality of sampling signal lines is sequentially selected for the sampling period. Furthermore, the horizontal scan circuit outputs a data signal, which specifies luminance of each of light-emitting elements arranged along each data signal line in a time sharing manner, to each data signal line.

BRIEF DESCRIPTION OF THE DRAWINGS

The invention will be described with reference to the accompanying drawings, wherein like reference numerals are used to identify the same or similar parts.

DESCRIPTION OF EXEMPLARY EMBODIMENTS

First Embodiment

Figure 1:
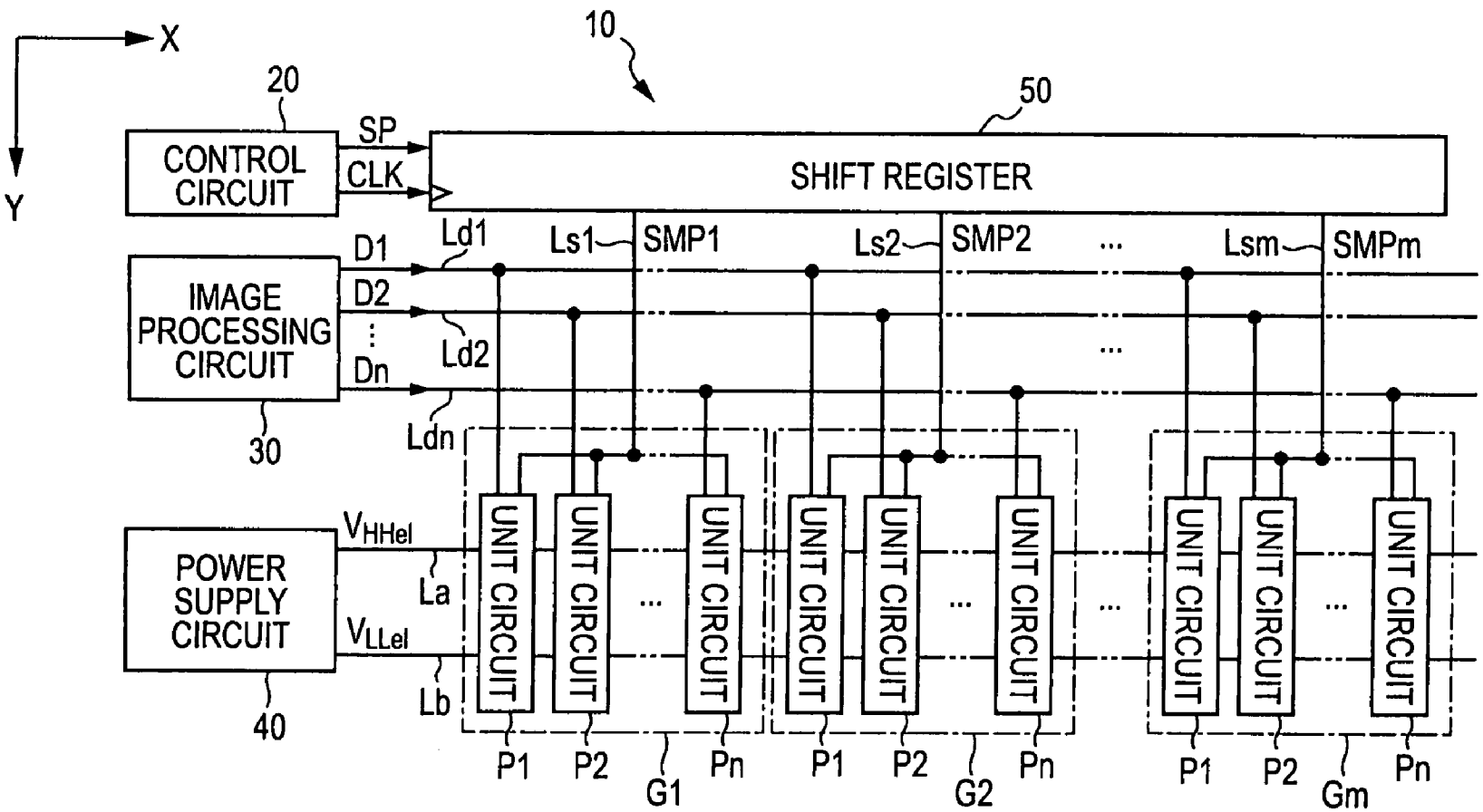
FIG. 1 is a block diagram showing the construction of a light-emitting device according to a first embodiment of the invention.

An embodiment of a light-emitting device adopted in a head of an image forming apparatus (e.g., a printer) will be first described. FIG. 1 is a block diagram showing the construction of a light-emitting device. As shown in FIG. 1, the light-emitting device includes a pixel unit 10 and peripheral circuits. The pixel unit 10 is a part used as a head (a line type optical head) of an image forming apparatus. The pixel unit 10 includes m unit circuit groups G (G1, G2, . . . , Gm) arranged in a X direction, and a m-bit shift register 50

(where m is a natural number) corresponding to the m unit circuit groups G. Each of the unit circuit groups G1 to Gm has n unit circuits P (P1, P2, . . . , Pn) arranged in the X direction. Each of the unit circuits P has an OLED element 83 serving as a light-emitting element (refer to FIG. 3).

Figure 2:
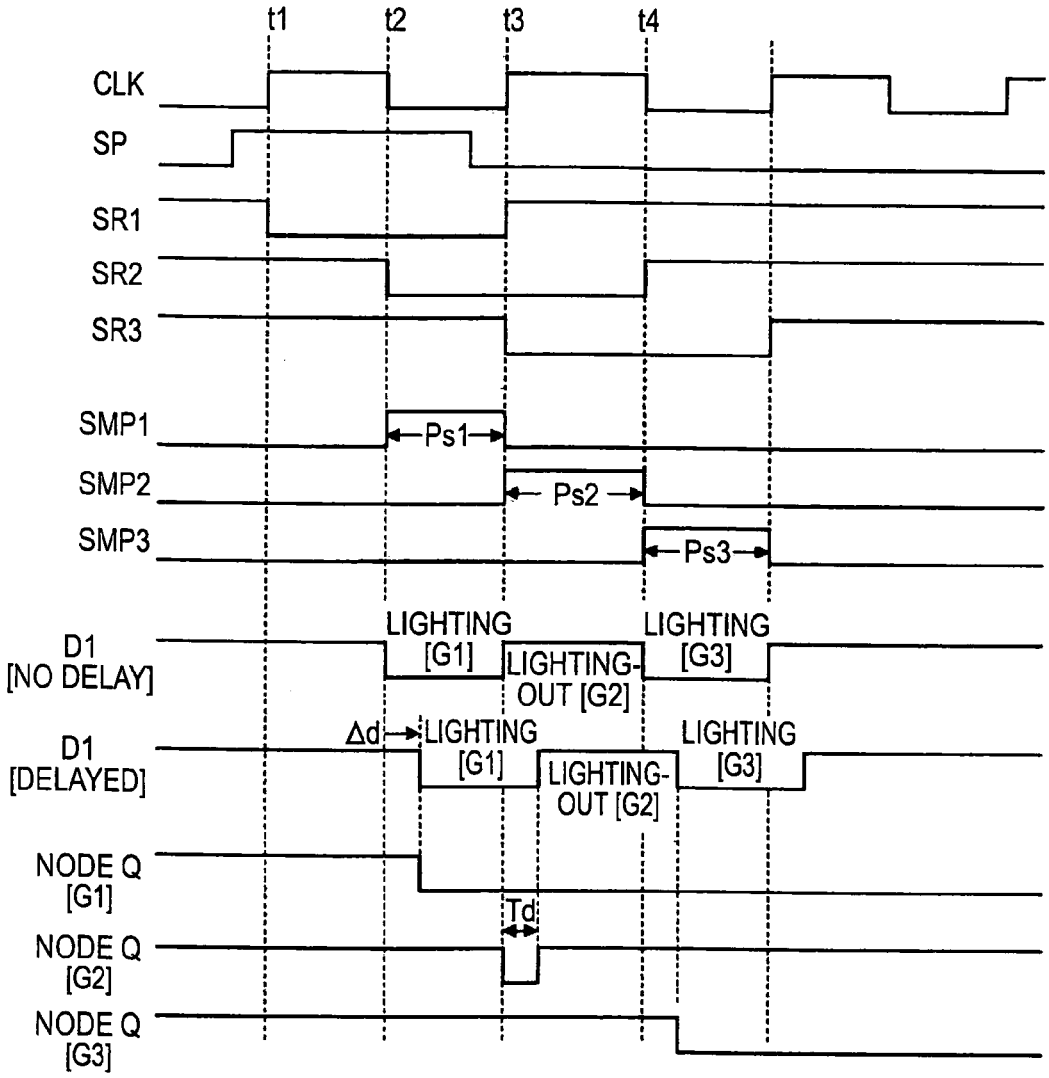
FIG. 2 is a timing diagram illustrating the operation of the light-emitting device.

Meanwhile, the peripheral circuits include a control circuit 20, an image processing circuit 30 and a power supply circuit 40. The control circuit 20 generates a start pulse signal SP and a clock signal CLK to output the generated signals to the shift register 50. As shown in FIG. 2, the start pulse signal SP is a signal that becomes an active level at the start point of a main scan period. Meanwhile, the clock signal CLK is a signal defining a time, which is a reference of the main scan period. As shown in FIG. 2, the shift register 50 sequentially shifts the start pulse signal SP corresponding to the clock signal CLK to generate m shift signals SR1 to SRm, and output m sampling signals SMP1 to SMPm based on the shift signals SR1 to SRm. Each of the shift signals SR (SR1, SR2, . . . , SRm) is a signal that becomes an active level (a low level) for a time length corresponding to one cycle of the clock signal CLK. Furthermore, as shown in FIG. 2, a period where each shift signal SRi (where "i" is an integer satisfying $1 \leqq i \leqq m$) becomes an active level and a period where the next shift signal SRi+1 becomes an active level overlap each other for a time length corresponding to a half cycle of the clock signal CLK. Meanwhile, each sampling signal SMPi is a signal corresponding to an NAND of an i-th shift signal SRi and its next shift signal SRi+1. Therefore, the sampling signals SMP1 to SMPm sequentially become an active level (a high level) for each of sampling periods Ps (Ps1, Ps2, . . . , Psm) corresponding to a half cycle of the clock signal CLK. The sampling signals SMP1 to SMPm are output to the unit circuits P of each of the unit circuit groups G1 to Gm through sampling signal lines Ls1 to Lsm, respectively.

The image processing circuit 30 shown in FIG. 1 generates n data signals D1 to Dn corresponding to a total number of unit circuits P included in one unit circuit group G. Each data signal Dj (where "j" is a natural number satisfying $1 \leqq j \leqq n$) is a voltage signal specifying luminance of the OLED element 83 of a unit circuit Pj included in each of the m unit circuit groups G1 to Gm based on the arrangement order of the unit circuit groups G1 to Gm, in a time sharing manner. Each of the data signals D1 to Dn of the present embodiment becomes either a high level or a low level in each unit period having the same time length as that of the sampling period Ps. A high level data signal Dj indicates lighting of the OLED element 83. A low level data signal Dj indicates lighting-out of the OLED element 83. These data signals D1 to Dn are output to data signal lines Ld1 to Ldn. To the data signal line Ldj is commonly connected the unit circuits Pj (a total of m unit circuits) included in each of the unit circuit groups G1 to Gm. The data signal Dj output from the image processing circuit 30 is supplied to a unit circuit Pj of a j-th column of each of the unit circuit groups G1 to Gm through the data signal line Ldj.

The power supply circuit 40 shown in FIG. 1 generates a high potential side power supply voltage VHHel and a low-potential side power supply voltage VLLel lower than the high-potential side power supply voltage VHHel in addition to a power supply voltage used in logic circuits such as the shift register 50. The high-potential side power supply voltage VHHel is supplied to a power supply line La and the low-potential side power supply voltage VLLel is supplied to a power supply line Lb. The entire unit circuits P are commonly connected to the power supply lines La, Lb and are supplied with the high-potential side power supply voltage VHHel and the low-potential side power supply voltage VLLel through the power supply lines La, Lb.

Figure 3:
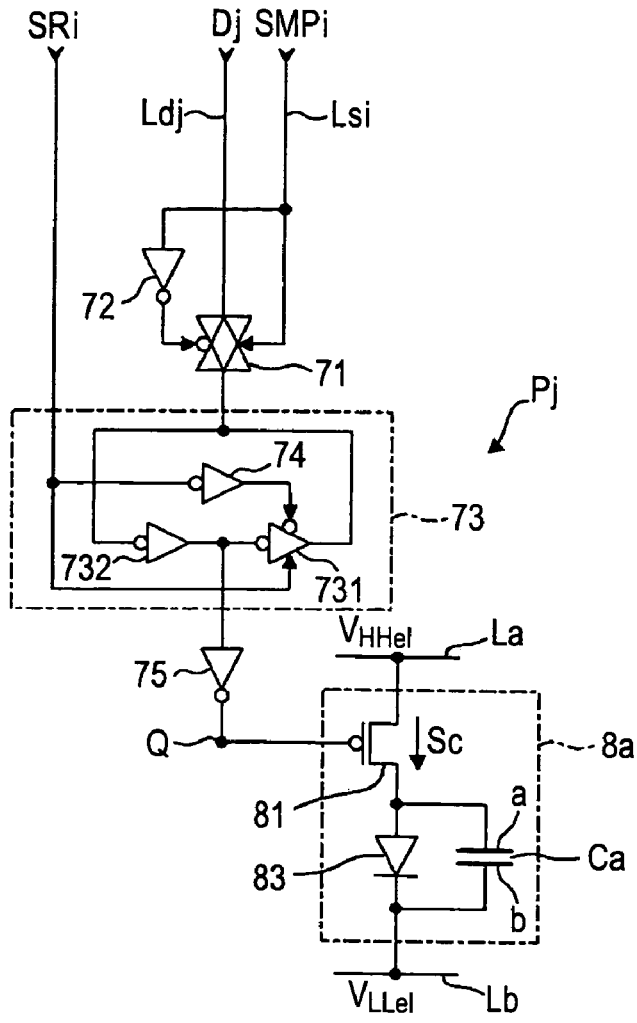
FIG. 3 is a circuit diagram illustrating the construction of one unit circuit.

Next, FIG. 3 is a circuit diagram illustrating the construction of the unit circuit Pj belonging to the unit circuit group Gi. As shown in FIG. 3, the unit circuit Pj has a transmission gate 71. The transmission gates 71 of unit circuits Pj of a j-th column included in the entire unit circuit groups G1 to Gm have input terminals commonly connected to the data signal line Ldj. The transmission gate 71 is a switching element that samples the data signal Dj on the basis of the sampling signal SMPi supplied from the shift register 50 through the sampling signal line Lsi. That is, the transmission gate 71 becomes an on-state for a period where the sampling signal SMPi and a signal whose logic level is inverted by an inverter 72 become an active level, and the data signal Dj is supplied to the unit circuit Pj accordingly.

A latch circuit 73 is connected to the output terminal of the transmission gate 71. The latch circuit 73 includes a clocked inverter 731 whose output terminal is connected to the transmission gate 71 and an inverter 732 whose input terminal is connected to the output terminal of the clocked inverter 731 and output terminal is connected to an input terminal of the clocked inverter 731. Each control terminal of the clocked inverter 731 is supplied with the shift signal SRi generated from the shift register 50 and a signal whose logic level is inverted by an inverter 74. The clocked inverter 731 becomes a high impedance state for a period where the shift signal SRi is maintained in an active level (a low level), and serves as an inverter for a period where the shift signal Sri is maintained in an inactive level (a high level).

To an output terminal of the latch circuit 73 (the output terminal of the inverter 732) is connected an input terminal of an inverter 75. An output terminal of the inverter 75 is connected to a pixel circuit 8*a* via a node Q. The pixel circuit 8*a* includes a p channel type transistor (hereinafter referred to as a "driving transistor") 81, the OLED element 83 and a capacitor Ca. The OLED element 83 is a light-emitting element in which a light-emitting layer formed of an organic electroLuminescent (EL) material is interposed between the anode (a first electrode) and the cathode (a second electrode).

A source electrode of the driving transistor 81 is connected to the power supply line La to which the high-potential side power supply voltage VHHel is applied, and a drain electrode of the driving transistor 81 is connected to the anode of the OLED element 83. The cathode of the OLED element 83 is connected to the power supply line Lb to which the low-potential side power supply voltage VLLel is applied. Meanwhile, the capacitor Ca is parallel to the OLED element 83. That is, one electrode (a) of the capacitor Ca is connected to the anode of the OLED element 83, and the other electrode (b) is connected to the cathode (or the power supply line Lb) of the OLED element 83.

Figure 4:
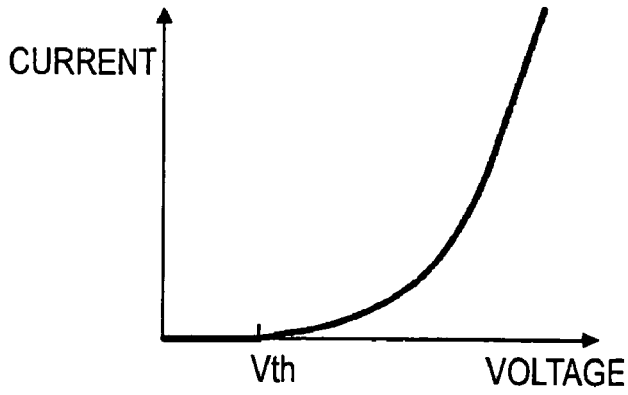
FIG. 4 is a view illustrating that an OLED element erroneously emits light in the unit circuit according to the related art.
Figure 5:
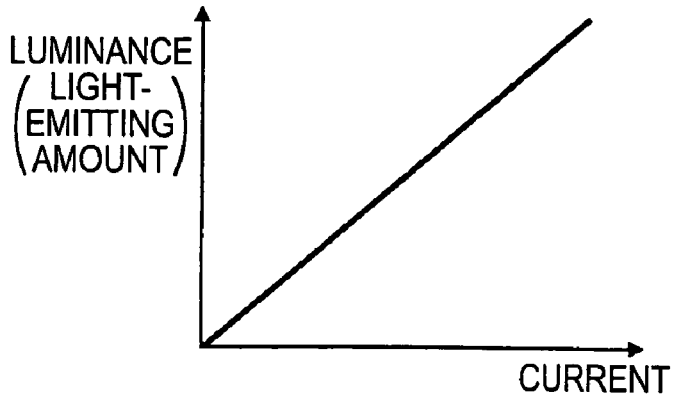
FIG. 5 is a view illustrating that erroneous light-emitting is prevented by a unit circuit of the present embodiment.

FIG. 4 is a graph illustrating the relationship between a voltage applied to the OLED element 83 and a current flowing through the OLED element 83. FIG. 5 is a graph illustrating the relationship between a current flowing through the OLED element 83 and a luminance (a light-emitting amount) of the OLED element 83. If a voltage applied to the OLED element 83 is lower than a threshold value Vth as shown in FIGS. 4 and 5, the OLED element 83 is turned out (luminance becomes zero) since the current becomes zero. Meanwhile, if the voltage exceeds the threshold value Vth, a current corresponding to the voltage flows through the OLED element 83, and as a result, the OLED element 83 emits light with luminance proportional to the current. In the construction shown in FIG. 3, if the node Q is maintained in a low level, the driving transistor 81 becomes an on-state. Therefore, a voltage higher than the threshold value Vth is applied to the OLED element 83 to emit light. Meanwhile, if the node Q is maintained in a high level, the driving transistor 81 becomes an off-state. Therefore, the voltage applied to the OLED element 83 becomes lower than the threshold value Vth, and as a result, the OLED element 83 is turned out. A signal indicating a voltage applied to the OLED element 83 will be hereinafter referred to as a "driving signal Sc".

The operation of each of the unit circuits P will be described below. Furthermore, the operation of a unit circuit P1 belonging to the unit circuit group G1 will be mainly described below, which is also a description concerning the operation of the remaining unit circuits P.

In a start point t1 to a start point t2 shown in FIG. 2, since the shift signal SR1 is maintained in a low level, and the clocked inverter 731 becomes a high impedance state. Furthermore, since the sampling signal SMP1 is a low level, the transmission gate 71 becomes an off-state. Thereafter, in the start point t2 to a start point t3, while the shift signal SR1 is maintained in a low level, the sampling signal SMP1 becomes a high level. Therefore, while the clocked inverter 731 maintains a high impedance state, the transmission gate 71 becomes an on-state. Therefore, at the start point, the data signal D1 supplied to the data signal line Ld1 is supplied to the unit circuit P1 through the transmission gate 71.

Thereafter, subsequently to the start point t3, since the shift signal SR1 becomes a high level, the clocked inverter 731 begins serving as an inverter. Furthermore, since the sampling signal SMP1 shifts to an off-state, the transmission gate 71 shifts to an off-state. Therefore, the supply of the data signal D1 in the unit circuit P1 is stopped. Thereafter, a logic level of the data signal D1 is kept in the latch circuit 73 until next supply of the data signal D1 begins.

In this case, when the data signal D1 is not delayed from a predetermined timing, the data signal D1 maintains a level corresponding to the luminance of each OLED element 83 over the entire period of the sampling period Ps where the level of the sampling signals SMP1 to SMPm becomes an active level, as indicated by 'D1 (no delay)' in FIG. 2. However, as indicated by 'D1 (delayed)' in FIG. 2, the data signal D1 may be delayed by a time length Δd the due to various reasons, such as a voltage drop and/or a rounded waveform in the data signal line Ld1. Furthermore, assuming that the OLED elements 83 of the unit circuits P1 respectively belonging to the unit circuit group G1 and the unit circuit group G3 emit light and the OLED elements 83 of the unit circuit P1 belonging to the unit circuit group G2 are turned out, a voltage of the node Q can be varied, as follows, due to the delay of the data signal D1.

Firstly, the data signal D1 is supplied to the unit circuit P1 of the unit circuit group G1 for the sampling period Ps1. The data signal D1 shifts to a low level at a timing where the data signal D1 is delayed from the start point of the sampling period Ps1 by the time length Δd, but is maintained in a low level even at the end point of the sampling period Ps1 where the logic level is maintained in the latch circuit 73. Therefore, the voltage of the node Q of the unit circuit P1 is maintained in a low level at a timing where the data signal D1 is delayed from the start point of the sampling period Ps1 by the time length Δd until the data signal D1 is subsequently supplied. As a result, the OLED elements 83 of the unit circuits P1 belonging to the unit circuit group G1 is continuously lighted over a predetermined time length as specified by the data signal D1. This is true of a unit circuit P1 of a first column, which belongs to the unit circuit group G3.

Meanwhile, the data signal D1 is supplied to the unit circuits P1 that belongs to the unit circuit group G2 for the sampling period Ps2 where the sampling signal SMP2 becomes an active level. When the data signal D1 is not delayed, the data signal D1 is maintained in a high level indicating the turning off of the OLED element 83 over the whole period of the sampling period Ps2. Since the data signal D1 has been delayed by the time length Δd as described above, however, the data signal D1 is maintained in a low level (i.e., a level indicating the turning on of the OLED elements 83 of the unit circuits P1 that belongs to the unit circuit group G1) for a period Td from the start point of the sampling period Ps2 to the elapse of the time length Δd. After the period Td elapses, the data signal D1 shifts to an original high level. For the sampling period Ps2, the clocked inverter 731 of the latch circuit 73 functions as an inverter. Therefore, for the period Td, the node Q becomes a low level and the driving transistor 81 of the pixel circuit 8*a* becomes an on-state.

Figure 6:
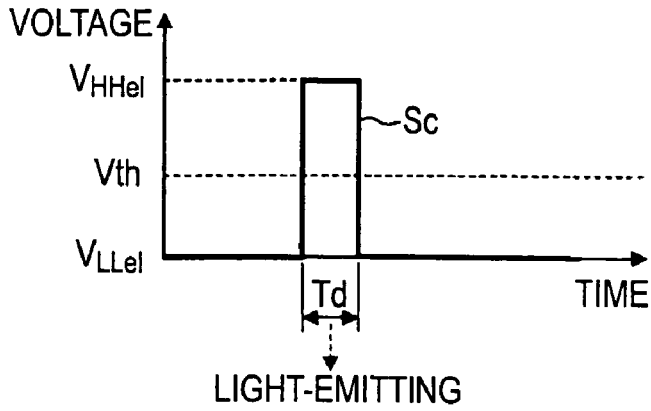
FIG. 6 is a graph showing the relationship between a voltage and a current of the OLED element.
Figure 7:
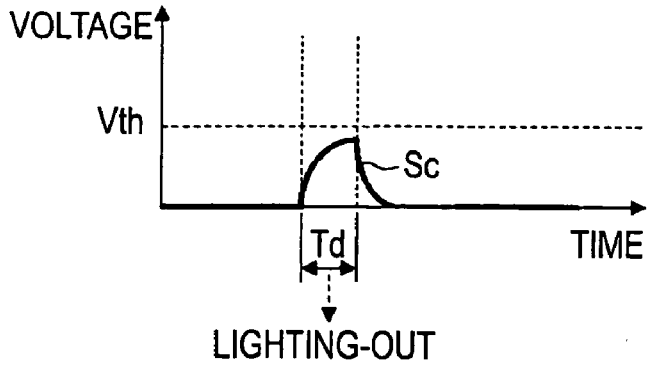
FIG. 7 is a graph showing the relationship between a current and luminance (a light-emitting amount) of the OLED element.

In this case, in the construction according to the related art in which the capacitor Ca is not disposed, if the driving transistor 81 shifts to an on-state for the period Td, a voltage of the driving signal Sc (i.e., a voltage applied to the OLED element 83) exceeds the threshold value Vth and then reaches the high-potential side power supply voltage VHHel, as shown in FIG. 6. Therefore, the OLED element 83 of the unit circuit group G2 that should have been turned out erroneously emit light. For this reason, in the present embodiment, the capacitor Ca disposed parallel to the OLED element 83 and resistance component or wiring resistance of the OLED element 83 constitute a RC time constant circuit. Therefore, as shown in FIG. 7, the rising of the driving signal Sc at the start point of the period Td is blunted. Furthermore, as the node Q shifts to a low level at the end point of the period Td, the driving transistor 81 becomes an off-state. As a result, the level of the driving signal Sc begins falling at the end point of the period Td before reaching the threshold value Vth. Therefore, the level of the driving signal Sc does not exceed the threshold value vth over the whole period of the period Td. To this end, erroneous emitting of the OLED element 83 is not generated. As described above, the capacitor Ca according to the present embodiment serves as a time constant circuit that rounds a waveform of the driving signal Sc to prevent erroneous emitting of the OLED element 83. Therefore, electrostatic capacitance of the capacitor Ca can be preferably set so that a waveform of the driving signal Sc is rounded as much as a level of the driving signal Sc does not exceed the threshold value Vth of the OLED element 83 over the whole period Td, which corresponds to the maximum value of the delay amount Δd of the data signal D1.

Corresponding to the present embodiment, a waveform of the driving signal Sc is rounded by the capacitor Ca. Therefore, even though the driving transistor 81 temporarily becomes an on-state due to the delay of the data signal D1, erroneous emitting of the OLED element 83, which is caused by the above causes, can be avoided. Therefore, in an image forming apparatus in which the light-emitting device is adopted in a head, an exposure amount for a photosensitive material can be controlled with high accuracy to form high quality images. Furthermore, it is not necessary to insert an interval between the sampling periods Ps as described above. Therefore, even though a period where the data signal Dj is sampled is short, the data signal Dj can be sufficiently supplied to each unit circuit Pj. Furthermore, according to the present embodiment, these effects can be obtained through a very simple construction in which the capacitor Ca is disposed.

As mentioned above, the pixel circuit 8*a* of the present embodiment includes the OLED element 83 (the light-emitting element), the power supply line La electrically connected to the anode of the OLED element 83, and the p channel type driving transistor 81 interposed between the power supply line La and the anode of the OLED element 83, to control a driving current of the OLED element 83. Meanwhile, respective components (the transmission gate 71, the inverter 72, the latch circuit 73 and the inverter 75) including the sampling signal line Lsi to the gate electrode of the driving transistor 81 function as sampling circuits. The sampling circuit is a means that samples the data signal Dj from the data signal line Ldj on the basis of the sampling signal SMPi supplied from the sampling signal line Lsi, and supplies a voltage corresponding to the data level Dj to the gate electrode of the driving transistor 81.

As illustrated in the present embodiment, the RC time constant circuit can be preferably disposed between the power supply line La and the anode (the first electrode) of the OLED element 83. In other words, the RC time constant circuit is not interposed between the sampling circuit (more particularly, the inverter 75 located at the last end) and the gate electrode of the driving transistor 81. In this construction, the data signal Dj can be reliably and sufficiently supplied to each unit circuit Pj in comparison with, e.g., a construction in which the RC time constant circuit is interposed between the sampling circuit and the driving transistor 81. Furthermore, if the RC time constant circuit is interposed between the power supply line La and the anode of the OLED element 83 as in the present embodiment, erroneous emitting of the OLED element 83 can be prevented by the RC time constant circuit, as described above, even when the driving transistor 81 shifts to an on-state for the period Td due to the delay of the data signal Dj.

Second Embodiment

An example of a light-emitting device adopted as a display apparatus of various electronic devices will be described below with reference to FIG. 8. Furthermore, the same reference numerals as those of the first embodiment are used to identify the same or similar parts. Therefore, description thereof will be omitted for simplicity.

Figure 8:
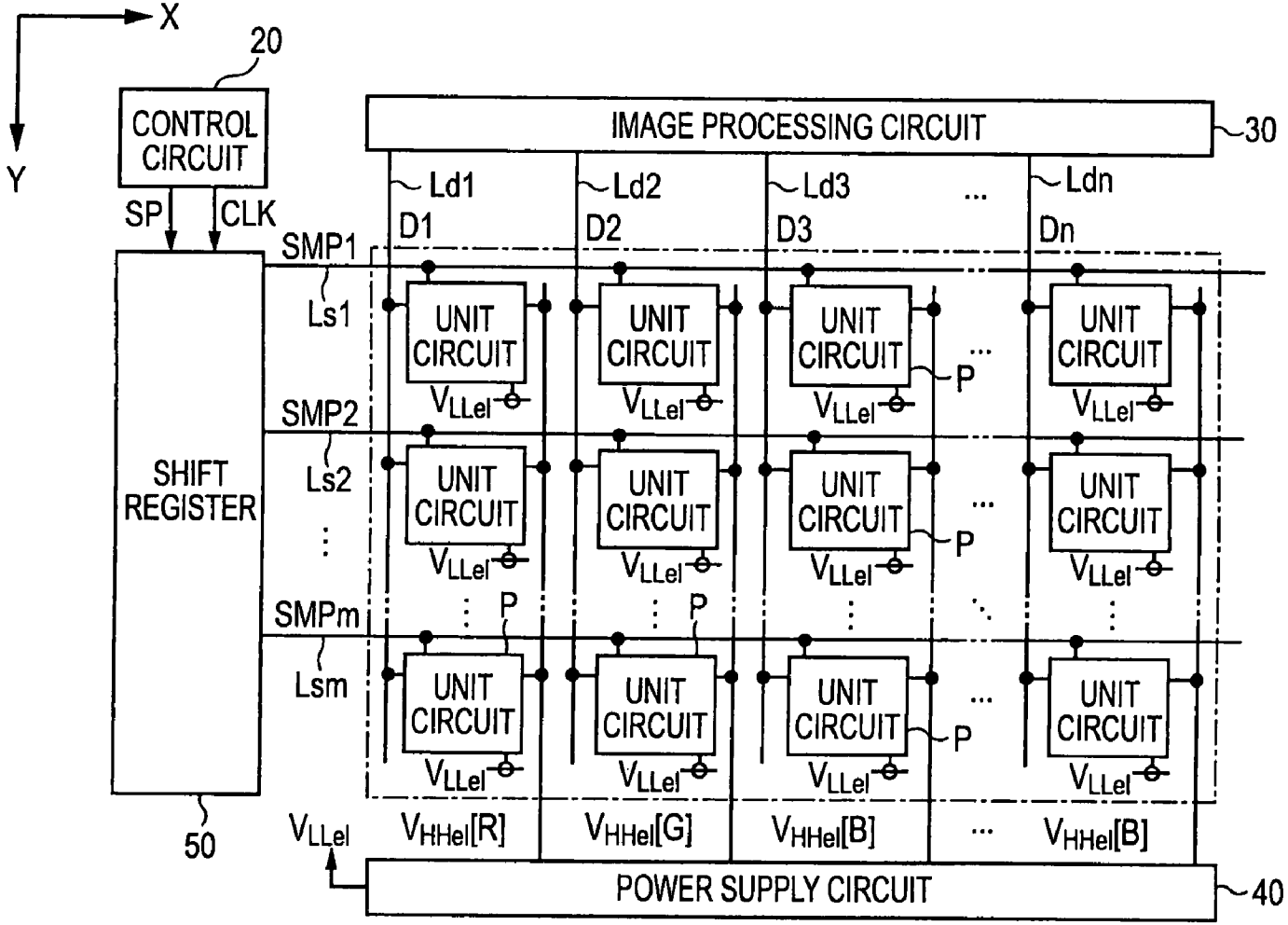
FIG. 8 is a block diagram showing the construction of a light-emitting device according to a second embodiment of the invention.

As shown in FIG. 8, the light-emitting device includes m sampling signal lines (scan lines) Ls1 to Lsm that extend in a X direction and are connected to output terminals of a shift register 50, respectively, and n data signal lines Ld1 to Ldn that extend in a Y direction and are connected to output terminals of an image processing circuit 30, respectively. Unit circuits P are disposed at intersections of the sampling signal lines Ls1 to Lsm and the data signal lines Ld1 to Ldn. Therefore, these unit circuits P are arranged in an m by n matrix in the X direction and the Y direction. The construction of each unit circuit P, or the function or operation of each peripheral circuit is the same as that of the first embodiment.

Each of the m unit circuits P that is arranged in a Y direction along the data signal lines Ld1 to Ldn has an OLED element 83 that emits any one of a red light component, a green light component, and a blue light component. For example, each unit circuit P of a first column can have a red OLED element 83, each unit circuit P of a second column can have a green OLED element 83 and each unit circuit P of a third column can have a blue OLED element 83. A power supply circuit 40 generates a high-potential side power supply voltage VHHel[R] supplied to each unit circuit P of a column corresponding to the red, a high-potential side power supply voltage VHHel[G] supplied to each unit circuit P of a column corresponding to the green, and a high-potential side power supply voltage VHHel[B] supplied to each unit circuit P of a column corresponding to the blue, as well as a low-potential side power supply voltage VLLel.

In the above construction, if a sampling signal SMPi supplied from the shift register 50 to the sampling signal line Lsi shifts to an active level for a sampling period Psi, transmission gates 71 of the n unit circuits P of an i-th row all become an on-state. Data signals D1 to Dn supplied from the image processing circuit 30 to the data signal lines Ld1 to Ldn, respectively, are supplied from the transmission gates 71 to the unit circuits P for the sampling period Psi. The unit circuit P of the present embodiment includes the capacitor Ca disposed parallel to the OLED element 83 as shown in FIG. 3. Therefore, although the data signal Dj has been delayed from the sampling period Psi, erroneous emitting of the OLED element 83 caused by the delay of the data signal Dj, can be prevented. Therefore, high quality display can be realized by controlling the luminance of each OLED element 83 with high accuracy. Furthermore, the light-emitting device of an active matrix type in which the driving transistor 81 for controlling the OLED element 83 is disposed in the unit circuit P has been described above. However, the invention can also be applied to a light-emitting device of a passive matrix type in which the switching element is not used.

Third Embodiment

Another examples of the unit circuit P will be described below with reference to FIGS. 9 to 12. Furthermore, the same reference numerals as those of the first and embodiments are used to identify the same or similar parts. Description thereof will be omitted for simplicity.

EXAMPLE 1

Figure 9:
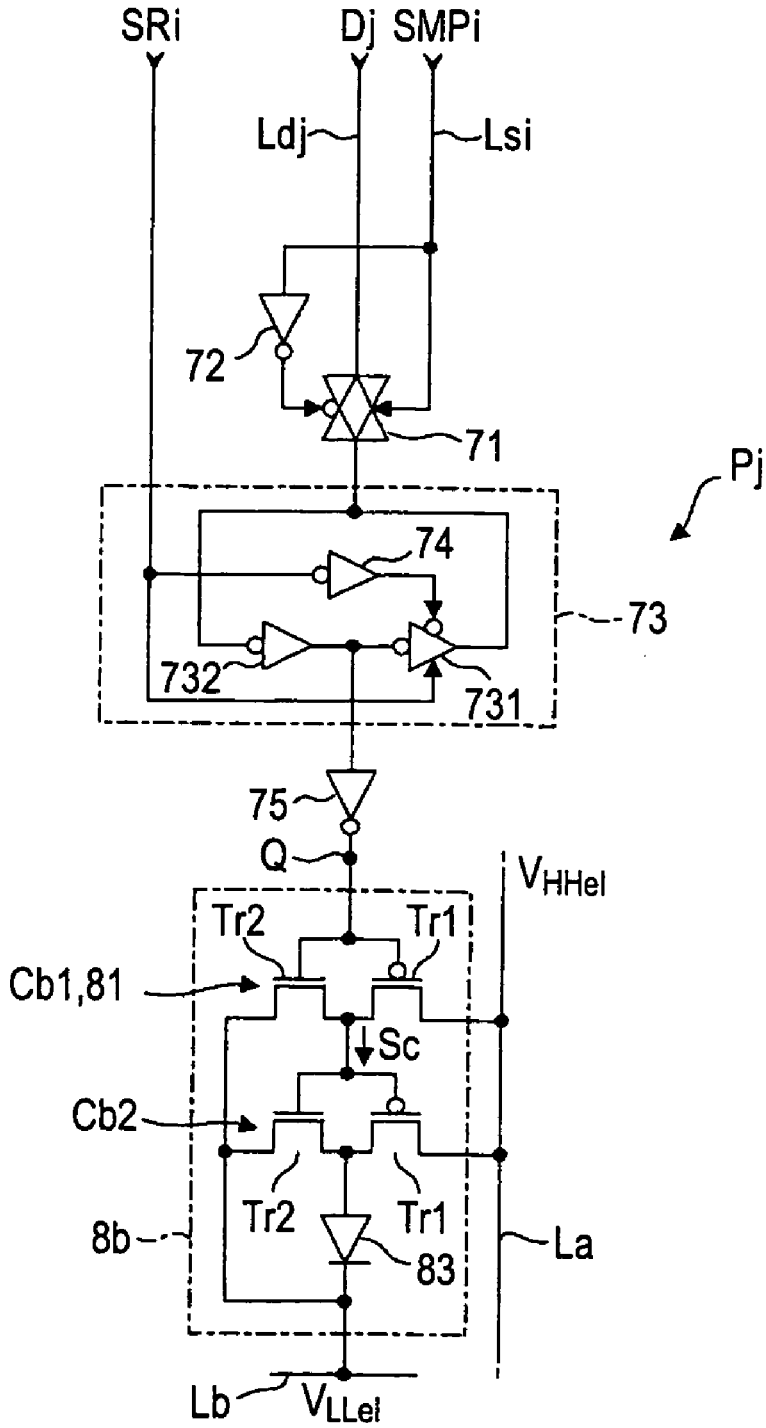
FIG. 9 is a circuit diagram illustrating the construction of a unit circuit according to a third embodiment of the invention.

FIG. 9 is a circuit diagram illustrating the construction of a unit circuit P(Pj) according to Example 1 of the present embodiment. As shown in FIG. 9, a pixel circuit 8*b* of the unit circuit P according to Example 1 includes two inverters Cb (Cb1 and Cb2) instead of the driving transistor 81 and the capacitor Ca shown in FIG. 3. Each of the inverters Cb includes a p channel type transistor Tr1 and an n channel type transistor Tr2 whose drain electrodes are connected with each other. A source electrode of the transistor Tr1 is connected to a power supply line La and a source electrode of the transistor Tr2 is connected to a power supply line Lb. Furthermore, an input terminal of the inverter Cb1 is connected to an output terminal of an inverter 75 and an output terminal of the inverter Cb1 is connected to an input terminal of the inverter Cb2. An output terminal of the inverter Cb2 is connected to the anode of an OLED element 83.

In Example 1, gate capacitance and output impedance of each of the transistors Tr1, Tr2 form a time constant circuit. Therefore, the inverter Cb1 and the inverter Cb2 serve as means (the driving transistor 81 in the first embodiment or the second embodiment) that generate a driving signal Sc corresponding to a data signal Dj. The inverter Cb1 and the inverter Cb2 also serve as a time constant circuit that rounds a waveform of the driving signal Sc. If the relationship between the driving signal Sc and the inverters Cb1, Cb2 conveniently defines, the function of generating the driving signal Sc corresponding to the data signal Dj is realized by the inverter Cb1 (or the transistor Tr1 or Tr2 which is a part of the inverter Cb1) and the function of rounding the waveform of the driving signal Sc is realized by the inverter Cb2 (or both the inverters Cb1, Cb2).

Figure 10:
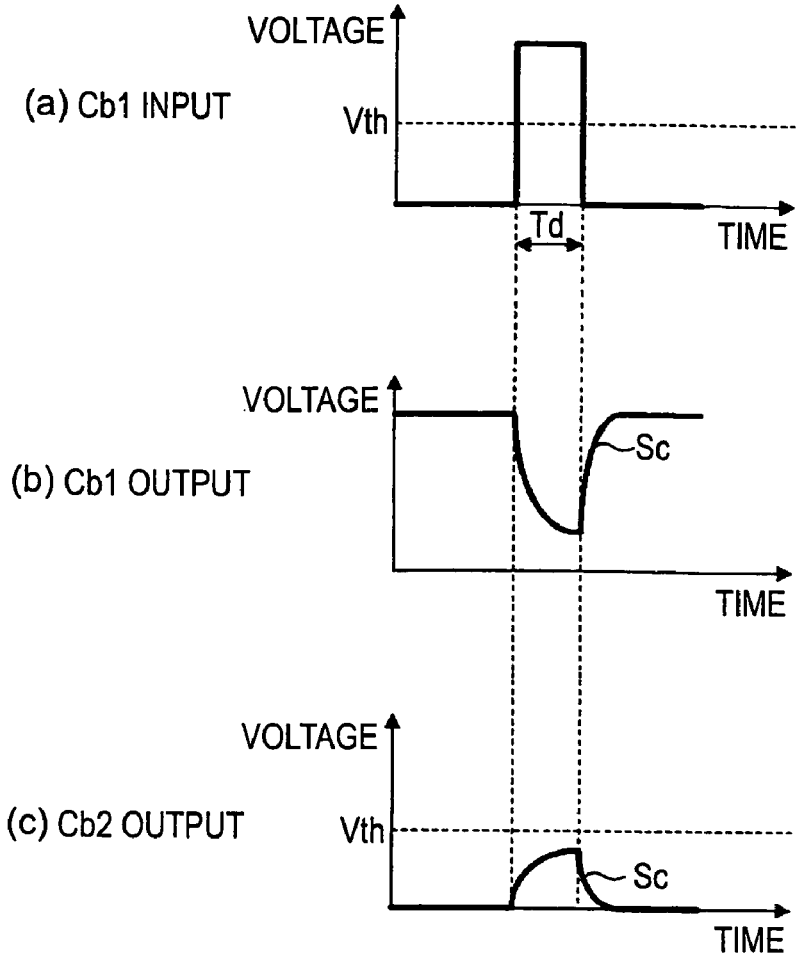
FIG. 10 is a view illustrating a state where a driving signal is varied.

As shown in (a) part of FIG. 10, a potential of the input terminal of the inverter Cb1 has a square wave whose rising and falling are sharp for the period Td. However, the driving signal Sc output from the inverter Cb1 has an inverted logic level and also has a rounded waveform, as shown in (b) part of FIG. 10. Furthermore, the driving signal Sc output from the inverter Cb2 has rounded waveform and has a signal lower than the threshold value Vth of the OLED element 83 over the whole period Td, as shown in (c) part of FIG. 10. Therefore, even though the node Q shifts to a low level for the period Td due to the delay of the data signal Dj, erroneous emitting of the OLED element 83 can be avoided in the same manner as the first embodiment. In Example 1, the inverter Cb (more particularly, the inverter Cb2) functions as a time constant circuit as described above. A time constant of the time constant circuit can be controlled by properly selecting a total number of the inverters Cb in the pixel circuit 8*b* or a characteristic (a gate length and/or a gate width) of the transistors Tr1, Tr2 in each inverter Cb.

EXAMPLE 2

Figure 11:
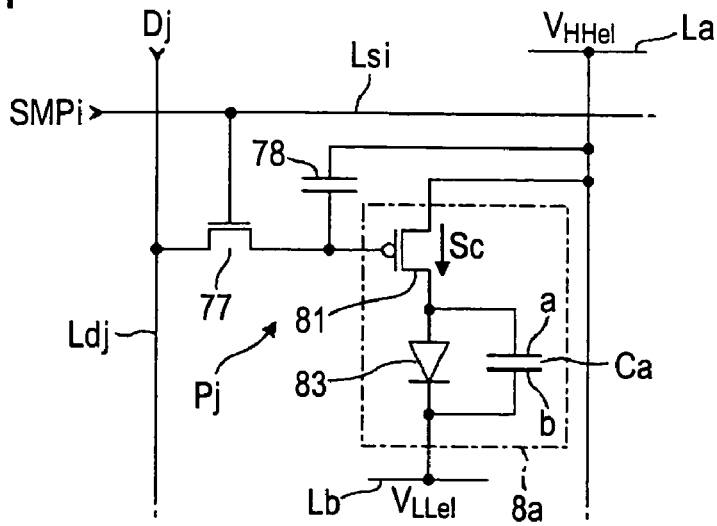
FIG. 11 is a circuit diagram illustrating the construction of a unit circuit according to another example.

FIG. 11 is a circuit diagram illustrating the construction of a unit circuit P (the unit circuit Pj of a j-th column belonging to the unit circuit group Gi) according to Example 2 of the present embodiment. As shown in FIG. 11, the unit circuit P according to Example 2 includes a transistor 77 and a storage capacitor 78 as well as a pixel circuit 8*a*, which is the same as that of FIG. 3. The transistor 77 is an n channel type transistor, and has a source electrode connected to a data signal line Ldj and a drain electrode connected to a gate electrode of a driving transistor 81 of the pixel circuit 8*a*. A gate electrode of the transistor 77 is supplied with a sampling signal SMPi from a sampling signal line Lsi. Meanwhile, the storage capacitor 78 is a capacitor having one end connected to the gate electrode of the driving transistor 81 and the other end connected to a power supply line La (or the other power supply line). The pixel circuit 8*a* includes a capacitor Ca disposed parallel to the OLED element 83 in the same manner as FIG. 3.

In this construction, if the transistor 77 shifts to an on-state when the sampling signal SMPi is applied, a logic level of the data signal Dj that has been supplied to the data signal line Ldj at the timing is applied to the gate electrode of the driving transistor 81. Furthermore, since the logic level is kept by the storage capacitor 78, the sampling signal SMPi becomes an inactive level. Therefore, even after the transistor 77 shifts to an off-state, the driving transistor 81 is maintained in a state depending on the data signal Dj supplied to the unit circuit P for the sampling period Ps immediately before that. In Example 2, the capacitor Ca serving as a time constant circuit is disposed in the pixel circuit 8*a* in the same manner as the first embodiment. Therefore, erroneous emitting of the OLED element 83 caused by the delay of the data signal Dj can be prevented.

EXAMPLE 3

Figure 12:
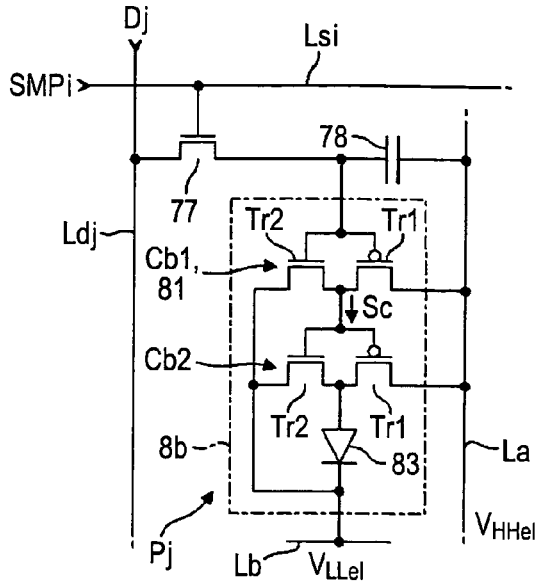
FIG. 12 is a circuit diagram illustrating the construction of a unit circuit according to another example.

FIG. 12 is a circuit diagram illustrating the construction of a unit circuit P according to Example 3 of the present embodiment. As shown in FIG. 12, the unit circuit P of Example 3 includes a pixel circuit 8*b* (refer to FIG. 9) having two inverters Cb1, Cb2, instead of the pixel circuit 8*a* (FIG. 11) having the capacitor Ca. As described above in Example 1, even in Example 3, erroneous emitting of the OLED element 83 caused by the delay of the data signal Dj can be prevented.

The Others

It can be understood that the construction of the unit circuit P according to the invention (more particularly, the construction of a time constant circuit) is not limited to the above examples. For example, what the time constant circuits according to the above examples are properly combined can be adopted. That is, for example, a construction in which both the capacitor Ca and the inverter Cb are installed in the unit circuit P can be adopted. Furthermore, a construction in which a resistor is interposed between the driving transistor 81 and the OLED element 83 can be adopted. In this construction, the resistor interposed between the driving transistor 81 and the OLED element 83, and capacitance component of the OLED element 83 or parasitic capacitance of a wiring line constitutes a time constant circuit that rounds a waveform of the driving signal Sc. Therefore, a resistance value of the resistor is set so that a level of the driving signal Sc does not exceed the threshold value Vth of the OLED element 83 for the period Td. Furthermore, the construction of the unit circuit P can be properly varied. That is, the construction that the driving signal Sc corresponding to the data signal Dj supplied to the data signal line Ldj is supplied to the OLED element 83 may be enough, regardless of the construction of another components.

Furthermore, in each of the above Examples, for convenience of explanation, a portion including the pixel circuit 8 (8*a* or 8*b*), a means that supplies the data signal Dj from the data signal line Ldj (the transmission gate 71 of FIG. 3 or the transistor 77 of FIG. 11) and a means that maintains the data signal Dj (the latch circuit 73 of FIG. 3 or the storage capacitor 78 of FIG. 11) has been collectively referred to as the unit circuit Pj. However, a portion including the pixel circuit 8 (8*a* or 8*b*), and means that supplies the data signal Dj or a means that maintains the signal, of each example, can be considered as a pixel circuit of the invention.

Fourth Embodiment

The construction of a light-emitting device according to a fourth embodiment of the invention will now be described. Furthermore, the same reference numerals as those of the first to third embodiments are used to identify the same or similar parts. Description thereof will be omitted for simplicity.

Figure 13:
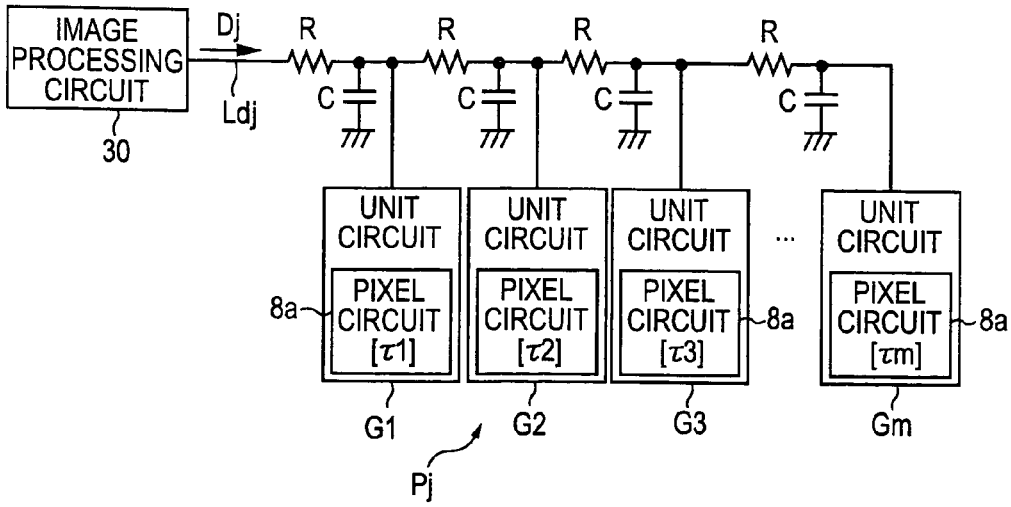
FIG. 13 is a view illustrating a time constant of each unit circuit according to a fourth embodiment of the invention.

FIG. 13 is a view showing one data signal line Ldj and m unit circuits Pj that are commonly connected to the data signal line Ldj, which are extracted from the light-emitting device of each of the embodiments. As shown in FIG. 13, the data signal line Ldj is accompanied by a wiring resistance R and is also accompanied by a parasitic capacitance C by capacitively coupling with other elements. A time constant caused by the wiring resistance R or the parasitic capacitance C becomes higher in proportion to the distance from an image processing circuit 30, i.e., a supply source of the data signal Dj along the data signal line Ldj. Therefore, if the same time constant is set in the time constant circuit (the capacitor Ca or the inverter Cb) in the pixel circuit 8 (8*a* or 8*b*) of the entire unit circuits Pj, the rounding degree caused by the time constant increases in proportion to the driving signal Sc of the unit circuit Pj distant from the image processing circuit 30. As a result, there may be a problem in which luminance of each OLED element 83 is irregularly distributed (deviated) along the data signal line Ldj. For this reason, in the present embodiment, a time constant of a time constant circuit in the unit circuit Pj (the pixel circuit 8) located close to the image processing circuit 30 along the data signal line Ldj is set to be higher than that of a time constant circuit of a unit circuit Pj (the pixel circuit 8) connected at a location, which becomes more distant from the image processing circuit 30 than the above. In more detail, a time constant $\tau i$ of a time constant circuit of a unit circuit Pj belonging to each unit circuit group Gi is set to satisfy the relationship $\tau 1 > \tau 2 > \ldots > \tau m$. The fact that the time constant $\tau i$ is set by electrostatic capacitance of the capacitor Ca or a total number (or a characteristic of the transistors Tr1, Tr2) of the inverter Cb is the same as that described above. According to this construction, the sum of the rounding degree of the driving signal Sc, which is caused by the wiring resistance R and the parasitic capacitor C, and the rounding degree of the driving signal Sc, which is caused by the time constant circuit of the unit circuit P, can be almost approximated in the entire unit circuits Pj. It is thus possible to prohibit deviation in luminance depending on the data signal line Ldj.

Furthermore, the construction in which the time constant is separately set in each of the entire unit circuits Pj has been described above. However, a construction in which the time constant is individually set for every group of the unit circuits Pj is also possible. For example, in a state where the m unit circuits Pj connected to the common data signal line Ldj are divided into two groups at the center of the X direction, a time constant of a time constant circuit in each of the unit circuits Pj can be set on a group basis in such a manner that a time constant $\tau a$ of each of the unit circuits Pj of a group located close to the image processing circuit 30, of the two groups, and a time constant $\tau b$ of each of the unit circuits Pj of a group located far apart from the image processing circuit 30, of the two groups, satisfy the relationship $\tau a > \tau b$. Furthermore, it has been described that the m unit circuits Pj are divided into two groups. However, a total number of groups and a dividing method can be changed, if needed. For example, the m unit circuits Pj can be divided into three or more groups, and unit circuits Pj of a group close to the image processing circuit 30 can be set to have a lower time constant of a time constant circuit.

The Other Embodiments

It has been illustrated in FIGS. 3 and 11 that the electrode b of the capacitor Ca is connected to the cathode of the OLED element 83, but a point where the electrode b is connected can be arbitrarily changed. That is, a predetermined voltage can be applied to the electrode b. Furthermore, a conduction type of the driving transistor 81 included in the unit circuit P (or the transistor 77 of FIGS. 11 and 12) can be appropriately changed.

The light-emitting device employing the OLED element 83 has been described in each embodiment. However, the invention can also be applied to a light-emitting device employing other light-emitting elements. For example, the invention can be applied to a variety of light-emitting devices such as a light-emitting device employing an inorganic EL device, a field emission display (FED), a surface-conduction electron-emitter display (SED), a ballistic electron surface emitting display (BSD) and a display apparatus employing a light-emitting diode.

Electronic Apparatus

The light-emitting device illustrated in each embodiment can be used in various electronic apparatus. The construction of an image forming device, i.e., an example of an electronic apparatus according to the invention will be described below.

Figure 14:
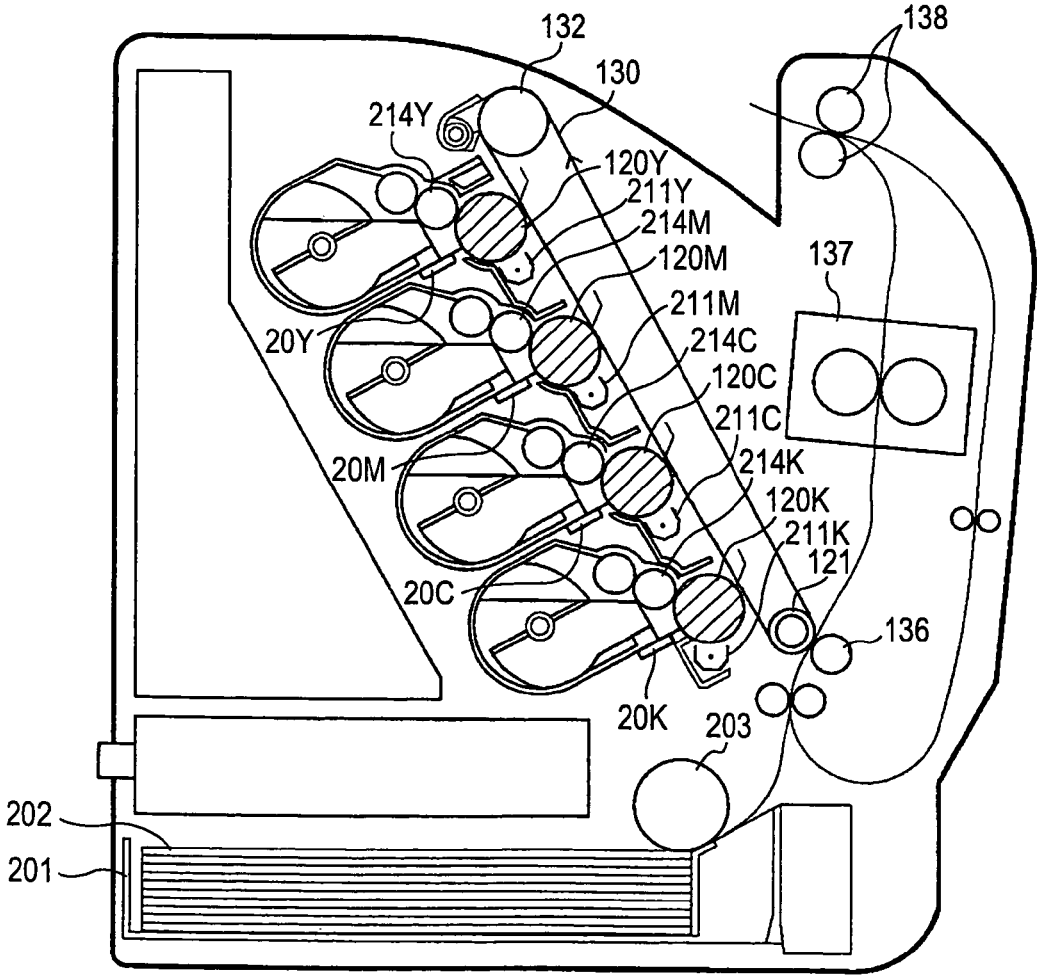
FIG. 14 is a longitudinal sectional view showing the construction of an image forming apparatus.

FIG. 14 is a longitudinal sectional view illustrating the construction of an image forming apparatus employing the light-emitting device according to each of the embodiments. The image forming apparatus includes four organic EL array exposure heads 20K, 20C, 20M and 20Y, which have the same construction and are disposed at exposure locations of four photosensitive drums (image carriers) 120K, 120C, 120M and 120Y corresponding to the four organic EL array exposure heads 20K, 20C, 20M and 20Y, respectively. The image forming apparatus is an image forming apparatus of a tandem method. The organic EL array exposure heads 20K, 20C, 20M and 20Y are constructed of the pixel unit 10 of the light-emitting device according to each embodiment.

As shown in FIG. 14, the image forming apparatus includes a driving roller 121 and a driven roller 132 therein. The image forming apparatus further includes an intermediate transfer belt 130 that is circularly driven in a direction of an arrow. Four image carriers 120K, 120C, 120M and 120Y each having a photosensitive layer on its outer circumference are spaced apart from the intermediate transfer belt 130 at predetermined intervals. Symbols "K, C, M and Y" in reference numerals 120K, 120C, 120M and 120Y designate the black, cyan, magenta and yellow, respectively, and they indicate black, cyan, magenta and yellow photosensitive materials, respectively. The same principle can be applied to other elements. The photosensitive materials 120K, 120C, 120M and 120Y are rotated in synchronization with the driving of the intermediate transfer belt 130.

Charge means (corona electrification unit) 211 (K, C, M and Y) that uniformly charges the outer circumferences of the photosensitive materials 120 (K, C, M and Y), respectively, and organic EL array exposure heads 20 (K, C, M and Y) that sequentially line scan the outer circumferences of the photosensitive materials 120 (K, C, M and Y), which have been uniformly charged by the charge means 211 (K, C, M and Y), in synchronization with the rotation of the photosensitive materials 120 (K, C, M and Y) are disposed around the photosensitive materials 120 (K, C, M and Y). The image forming apparatus further includes development apparatuses 214 (K, C, M and Y) that change a visible image into a toner image by applying a toner, i.e., a developer to an electrostatic latent image formed by the organic EL array exposure heads 20 (K, C, M and Y).

In this case, the organic EL array exposure heads 20 (K, C, M and Y) are disposed such that an array direction of the organic EL array exposure heads 20 (K, C, M and Y) follows the bus bar of the photosensitive drums 120 (K, C, M and Y). Furthermore, a light-emitting energy peak wavelength of each of the organic EL array exposure heads 20 (K, C, M and Y) and a sensitivity peak wavelength of each of the photosensitive materials 120 (K, C, M and Y) are set to be approximately identical to each other.

The development apparatus 214 (K, C, M and Y) can use non-magnetic single component toner as a developer. The development apparatuses 214 (K, C, M and Y) can convey the single component developer to a development roller using a supply roller, and regulates a film thickness of the developer adhered to the surface of the development roller using a regulation blade. The development apparatus 214 (K, C, M and Y) then presses the development roller against the photosensitive materials 120 (K, C, M and Y) or allows the development roller to be brought in contact with the photosensitive materials 120 (K, C, M and Y), so that the developer is attached according to a potential of the photosensitive materials 120 (K, C, M and Y) and is thus developed as a toner image.

Black, cyan, magenta and yellow toner images formed by a four-color toner image formation station are firstly sequentially transferred onto the intermediate transfer belt 130 and then sequentially overlap one another on the intermediate transfer belt 130, to form a full color. A recording medium 202, which has been fed one by one from a paper feed cassette 201 by a pick-up roller 203, is sent to a secondary transfer roller 136. The toner images on the intermediate transfer belt 130 are secondarily transferred from the secondary transfer roller 136 to the recording medium 202, such as paper, and are then fixed on the recording medium 202 through a fixing roller pair 137, i.e., a fixing part. The recording medium 202 is then discharged onto a paper ejection tray formed on the apparatus by a paper ejection roller pair 138.

The image forming apparatus of FIG. 14 uses an organic EL array as writing means, as described above. Therefore, an apparatus can be miniaturized in comparison with a case where a laser scanning optical system is used.

An image forming apparatus according to another embodiment of the invention will now be described.

Figure 15:
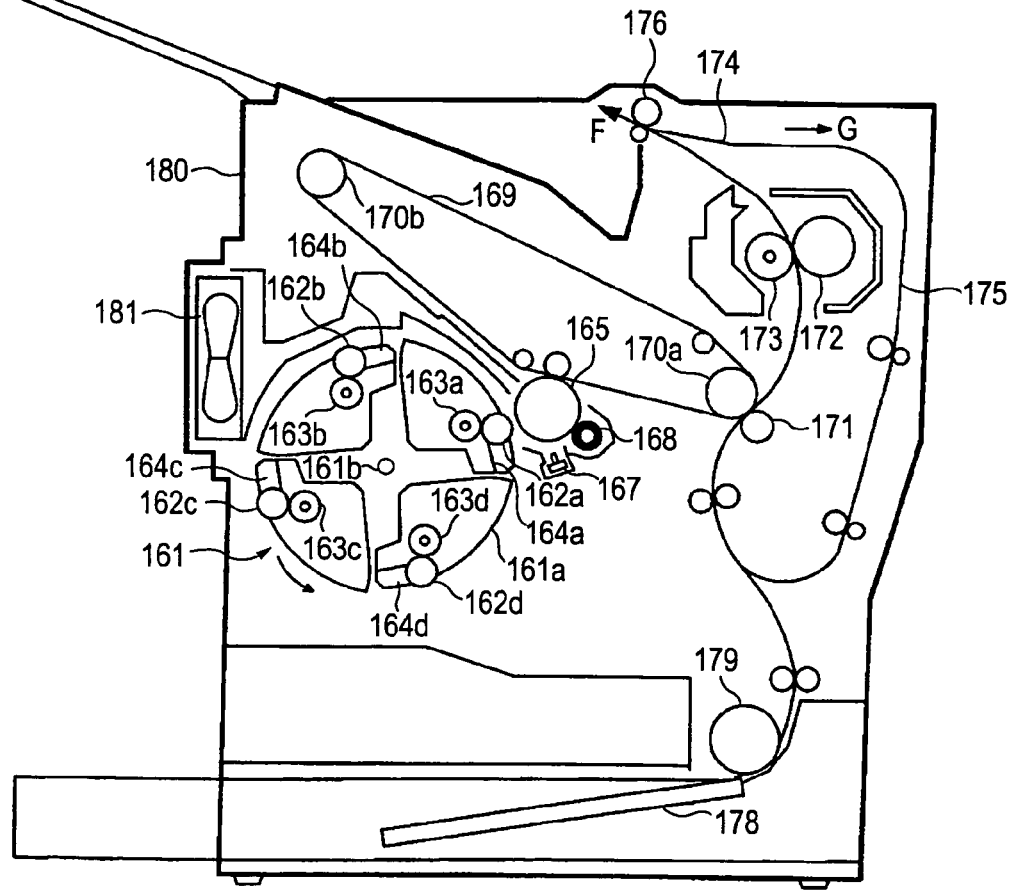
FIG. 15 is a longitudinal sectional view illustrating the construction of an image forming apparatus according to another example.
Figure 16:
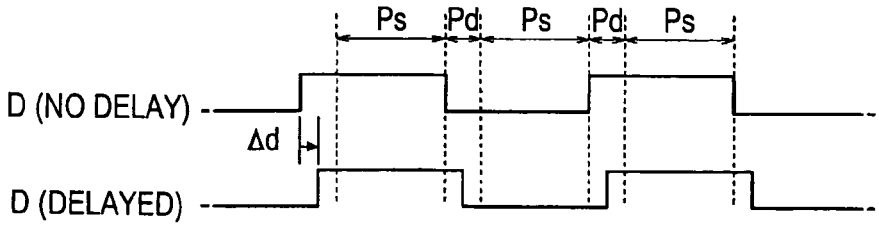
FIG. 16 is a timing diagram illustrating problems inhered in the related art construction.

FIG. 15 is a longitudinal sectional view illustrating the construction of an image forming apparatus according to another embodiment. In FIG. 15, the image forming apparatus includes a development apparatus 161 having a rotary construction, a photosensitive drum 165 serving as an image carrier, an exposure head 167 in which an organic EL array is installed, an intermediate transfer belt 169, a paper conveyance path 174, a heating roller 172, i.e., a fixing unit, and a paper feed tray 178, as main constituent elements. The exposure head 167 includes the pixel unit 10 of the light-emitting device according to each of the embodiment.

In the development apparatus 161, a development rotary 161*a* rotates around a shaft 161*b* in the counterclockwise direction. The interior of the development rotary 161*a* is divided into four sections. Four-color hieroglyphic formation type units of yellow (Y), cyan (C), magenta (M) and black (K) are disposed in the four sections, respectively. Development rollers 162*a* to 162*d* and toner supply rollers 163*a* to 163*d* are disposed in the four-color hieroglyphic formation type units, respectively. Furthermore, toner is regulated to a predetermined thickness by regulation blades 164*a* to 164*d*.

The photosensitive drum 165 is charged by an electrification unit 168 and is driven in a direction opposite to that of the development roller 162*a* by means of a driving motor (not shown), such as a step motor. The intermediate transfer belt 169 is hung over a driven roller 170*b* and a driving roller 170*a*. The driving roller 170*a* is coupled to the driving motor of the photosensitive drum 165 and transfers power to the intermediate transfer belt. As the driving motor is driven, the driving roller 170*a* of the intermediate transfer belt 169 rotates in an opposite direction to that of the photosensitive drum 165.

In the paper conveyance path 174 are disposed a plurality of conveyance rollers, a paper ejection roller pair 176 and the like, for conveying a paper. A single-sided image (a toner image) carried in the intermediate transfer belt 169 is transferred onto a single side of paper at a location of the secondary transfer roller 171. The secondary transfer roller 171 is attached to or detached from the intermediate transfer belt 169 by a clutch and is brought in contact with the intermediate transfer belt 169 when the clutch is on, so that the image is transferred onto the paper.

The paper on which the image has been transferred as described above undergoes a fixing process in a fixing unit having a fixing heater. The heating roller 172 and the pressure roller 173 are installed in the fixing unit. The paper on which the fixing process has been performed is introduced into the paper ejection roller pair 176 and then proceeds in a directing of an arrow F. In this state, if the paper ejection roller pair 176 rotates in an opposite direction, the paper has its direction reversed, and a double-sided print convey path 175 proceeds in a directing of an arrow G. The paper is ejected from the paper feed tray 178 one by one by a pick-up roller 179.

In the paper conveyance path, a low-speed brushless motor can be used as the driving motor that drives the convey roller. A step motor is also used as the intermediate transfer belt 169 since correction for color misalignment, etc. is required. These motors are controlled according to a signal generated from control means (not shown).

In the drawing, a yellow (Y) electrostatic latent image is formed on the photosensitive drum 165 and a high voltage is applied to the development roller 162*a*. Therefore, a yellow image is formed on the photosensitive drum 165. If yellow images at the front and rear sides are all supplied to the intermediate transfer belt 169, the development rotary 161*a* rotates by 90 degree.

The intermediate transfer belt 169 rotates once and then returns to the location of the photosensitive drum 165. A double-sided image of cyan (C) is then formed on the photosensitive drum 165. The image is overlapped with the yellow image supplied to the intermediate transfer belt 169. Thereafter, in the same manner as above, a process in which the development rotary 161*a* rotates by 90 degrees and the intermediate transfer belt 169 then rotates once after the image is carried in the intermediate transfer belt 169 is repeated.

To carry a four-color image, the intermediate transfer belt 169 rotates four times and then has its rotation location controlled again so that the image is transferred onto the paper at the secondary transfer roller 171. The paper conveyance path 174 conveys the paper feed from the paper feed tray 178, and a color image is thus transferred onto the single side of the paper at the secondary transfer roller 171. The paper having the single side on which the image is transferred is turned over in the paper ejection roller pair 176 as described above, and waits at the convey path. The paper is then conveyed to the location of the secondary transfer roller 171 at a proper timing, so that the color image is transferred on the other side of the paper. An exhaust fan 181 is disposed in a housing 180.

In the image forming apparatus according to each of the aforementioned examples, however, when an amount of light irradiated from the OLED element 83 onto an image carrier (e.g., the photosensitive drums 120 (K, C, M and Y) of FIG. 14 or the photosensitive drum 165 of FIG. 15) exceeds a threshold value Lth, an electrostatic latent image is formed. In this case, in the case where a voltage Vth1 to be applied to the OLED element 83 is higher than that of the OLED element 83 in order to irradiate the image carrier by an amount of light corresponding to the threshold value Lth, although the OLED element 83 has emitted light since a level of the driving signal Sc exceeds the voltage Vth due to the delay of the data signal Dj, if the level is lower than the voltage Vth1 (i.e., the amount of light irradiated on the image carrier is smaller than the threshold value Lth), the delay of the data line Dj does not effect on the electrostatic latent image formed on the image carrier. Therefore, in the case the light-emitting device according to the invention is adopted in an optical writing type image forming apparatus, a time constant of a time constant circuit can be set so that a level of the driving signal Sc for the period Td decreases to a level lower than the threshold value Vth1 for photosensitizing the image carrier (which can be a level exceeding the threshold value Vth).

Furthermore, the aforementioned light-emitting device can be applied to an image reading apparatus. The image reading apparatus includes a light-emitting unit that irradiate an object with light, and a reading unit that reads light reflected from the object and outputs an image signal. In the image reading apparatus, the above-mentioned light-emitting device can be used in the light-emitting unit. In this case, the light-emitting unit can be moved and the read unit can be fixed, or both the light-emitting unit and the read unit can be moved with respect to each other as one body. In the case of the latter, the read unit can consist of a TFT, and the read unit and the light-emitting unit can be formed using one substrate. The image reading apparatus constructed above may correspond to a scanner or a barcode reader.

Furthermore, it should be noted that electronic apparatuses to which the light-emitting device of the invention is applied are not limited to the image forming apparatus or the image reading apparatus. For example, the light-emitting device according to each embodiment can be used as display devices in various electronic apparatuses. The electronic apparatuses may include personal computers, mobile telephones, personal digital assistant (PDA), digital still cameras, television, video cameras, a car navigation apparatus, pagers, electronic organizers, electronic paper, electronic calculators, word processors, workstations, video phones, POS terminals, printers, scanners, copy machines, video players, devices having a touch panel and the like. The light-emitting device in which the plurality of unit circuits P is arranged in a plane form in the second embodiment can be properly used as these electronic apparatus.

What is claimed is:

1. A pixel circuit comprising:

a light-emitting element that emits with a luminance corresponding to a level of a driving signal and that has a first electrode and a second electrode;

a first supply line;

a second supply line that is connected to the second electrode; and a signal generating circuit that generates a driving signal indicating the luminance of the light-emitting element on the basis of a data signal, the signal generating circuit including a driving transistor that generates a driving signal by supplying a voltage corresponding to a data signal to its gate electrode, and a time constant circuit that rounds a waveform of the driving signal supplied from the driving transistor to the light-emitting element, and the driving transistor being connected between the first electrode and the first supply line.

2. The pixel circuit according to claim 1, wherein the light-emitting element emits light when a level of a driving signal exceeds a threshold value, and when, among data signals input to the signal generating circuit, a signal exceeding the threshold value is input to the signal generating circuit with a time length shorter than a predetermined time length, the time constant circuit sets a time constant so that a signal output from the time constant circuit decreases to a level lower than the threshold value of the light-emitting element.

3. The pixel circuit according to claim 1, wherein the light-emitting element includes first and second electrodes, and a power supply line electrically connected to the first electrode via the driving transistor, and the time constant circuit is disposed between the power supply line and the first electrode.

4. The pixel circuit according to claim 3, wherein the time constant circuit includes a capacitive element having one electrode connected to the first electrode of the light-emitting element and the other electrode applied with a predetermined potential.

5. The pixel circuit according to claim 4, wherein the time constant circuit includes a resistor interposed between the power supply line and the first electrode.

6. A pixel circuit comprising:

a light-emitting element that emits with a luminance corresponding to a level of a driving signal and that has a first electrode and a second electrode; and a signal generating circuit that generates a driving signal indicating the luminance of the light-emitting element on the basis of a data signal, the signal generating circuit including a first inverting circuit having first and second transistors, which are a complementary type, and a time constant circuit that rounds a waveform of the driving signal supplied from the signal generating circuit to the light-emitting element, the time constant circuit being a second inverting circuit having third and fourth transistors, which are a complementary type, a voltage corresponding to the data signal being supplied to an input terminal of the first inverting circuit, an output terminal of the first inverting circuit being connected to an input terminal of the second inverting circuit, and an output terminal of the second inverting circuit being connected to the first electrode.

7. A light-emitting device comprising:

a plurality of pixel circuits, each including a light-emitting element that has a luminance corresponding to a level of a driving signal; and a data signal line that transmits a data signal indicating a luminance of each light-emitting element in a time sharing manner, wherein each of the plurality of pixel circuits includes a signal generating circuit that generates a driving signal corresponding to a level of a data signal sampled from the data signal line for a sampling period corresponding to the pixel circuit, and the signal generating circuit includes a driving transistor that generates a driving signal by supplying a voltage corresponding to a data signal to a gate electrode, and a time constant circuit that rounds a waveform of the driving signal supplied from the driving transistor to the light-emitting element.

8. The light-emitting device according to claim 7, wherein the light-emitting element emits light when a level of a driving signal exceeds a threshold value, and when, among data signals input to the signal generating circuit, a signal exceeding the threshold value is input to the signal generating circuit with a time length shorter than a predetermined time length, the time constant circuit sets a time constant so that a signal output from the time constant circuit decreases to a level lower than the threshold value of the light-emitting element.

9. The light-emitting device according to claim 7, wherein a time constant of a time constant circuit included in a first pixel circuit of the plurality of pixel circuits is smaller than those included in a second pixel circuit connected to a point where a path length from a supply source of a data signal, of the data signal line, is shorter than that of the first pixel circuit.

10. The light-emitting device according to claim 9, wherein a time constant of a time constant circuit included in each pixel circuit is set for every pixel circuit so that wiring resistance and parasitic capacitance from a supply source of a data signal to a point where the pixel circuit is connected, of the data signal line, and a time constant of a portion including the time constant circuit of the pixel circuit approximately become the same for the entire pixel circuits.

11. The light-emitting device according to claim 9, wherein a time constant of the time constant circuit included in each pixel circuit is set for every group of the pixel circuit so that a time constant of a time constant circuit of each of pixel circuits belonging to a first group of the plurality of pixel circuits is smaller than that of a time constant circuit of each of pixel circuits belonging to a second group connected to a point where a path length from a supply source of a data signal, of the data signal line, is shorter than that of each pixel circuit of the first group.

12. An electronic apparatus comprising a plurality of pixel circuits, each including a light-emitting element that has a luminance corresponding to a level of a driving signal; and a data signal line that transmits a data signal indicating a luminance of each light-emitting element in a time sharing manner, wherein each of the plurality of pixel circuits includes a signal generating circuit that generates a driving signal corresponding to a level of a data signal sampled from the data signal line for a sampling period corresponding to the pixel circuit, and the signal generating circuit includes a driving transistor that generates a driving signal by supplying a voltage corresponding to a data signal to a gate electrode, and a time constant circuit that rounds a waveform of the driving signal supplied from the driving transistor to the light-emitting element.

* * * * *